US011944191B2

(12) United States Patent
Li

(10) Patent No.: US 11,944,191 B2
(45) Date of Patent: Apr. 2, 2024

(54) FOLDABLE BUFFET STATION

(71) Applicant: Remix Edition(Guangzhou) Commercial Equipment Co. Ltd., Guangdong Province (CN)

(72) Inventor: Yi Li, Guangdong Province (CN)

( * ) Notice: Subject to any disclaimer, the term of this patent is extended or adjusted under 35 U.S.C. 154(b) by 271 days.

(21) Appl. No.: 16/635,170

(22) PCT Filed: Nov. 28, 2019

(86) PCT No.: PCT/CN2019/000230
§ 371 (c)(1),
(2) Date: Nov. 7, 2021

(87) PCT Pub. No.: WO2021/051215
PCT Pub. Date: Mar. 25, 2021

(65) Prior Publication Data

US 2022/0053928 A1 Feb. 24, 2022

(30) Foreign Application Priority Data

Sep. 20, 2019 (CN) ..... 201921572206.6

(51) Int. Cl.
*A47B 31/04* (2006.01)
*A47F 10/06* (2006.01)

(52) U.S. Cl.
CPC ..... *A47B 31/04* (2013.01); *A47F 10/06* (2013.01); *A47B 2200/008* (2013.01)

(58) Field of Classification Search
CPC .... A47B 31/04; A47B 2200/008; A47F 10/06
(Continued)

(56) References Cited

U.S. PATENT DOCUMENTS 2,306,209 A * 12/1942 Jones ..... A47B 21/06 362/127
4,747,644 A * 5/1988 Gallery ..... B60B 33/06 312/262

(Continued)

FOREIGN PATENT DOCUMENTS

CN 109512148 A * 3/2019 ..... A47B 31/04

*Primary Examiner* — Daniel J Troy
*Assistant Examiner* — Timothy M Ayres

(57) ABSTRACT

This invention is a foldable buffet station comprising supporting legs and a countertop frame mounted on upper ends of the supporting legs. The supporting legs comprise two sets of supporting panels on left and right sides. Each set of the supporting panels comprises a front supporting panel and a rear supporting panel which are rotationally connected. The countertop frame comprises a front beam, a rear beam, and two left and right side beams which form a rectangular frame. The two left and right side beams are respectively fixed at upper ends of the two rear supporting panels on left and right sides. The rear beam is detachably fixed at upper ends of the two back side supporting panels. The front beam is fixed at upper ends of the two front side supporting panels. When it is necessary to fold the buffet cart, the cooking module on the countertop frame is removed first, and then the rear beam is removed; since the front supporting panels and the rear supporting panels are rotationally connected, pushing the two rear supporting panels at this time results in rotation and folding, and the side beams follow the corresponding supporting panels to rotate. As a result, the occupying space of the entire buffet cart can be greatly reduced, which is convenient for transportation and storage.

8 Claims, 11 Drawing Sheets

(58) Field of Classification Search
USPC ..... 108/115, 50.02, 50.01
See application file for complete search history.

(56) References Cited

U.S. PATENT DOCUMENTS

| | | | | | |
|---|---|---|---|---|---|
| 5,357,874 | A * | 10/1994 | Palmer | A47B 21/06 | 108/50.02 |
| 6,997,115 | B2 * | 2/2006 | Lockwood | A47B 3/0803 | 108/115 |
| 7,975,626 | B1 * | 7/2011 | Wang | A47B 3/002 | 108/50.01 |
| 9,089,210 | B2 * | 7/2015 | Kool | A47B 31/02 | |
| 9,381,605 | B2 * | 7/2016 | Moyer | B23Q 3/18 | |
| 10,117,513 | B1 * | 11/2018 | Tolentino | A47B 31/04 | |
| 10,897,991 | B2 * | 1/2021 | Polidoros | A47B 31/04 | |
| D970,960 | S * | 11/2022 | Li | D6/686 | |
| 11,523,685 | B2 * | 12/2022 | Kilgallon | A47B 13/003 | |

* cited by examiner

FOLDABLE BUFFET STATION

BACKGROUND OF THE INVENTION

The present invention relates to the technical field of cooking, and more specifically relates to a foldable buffet station.

Many hotels nowadays provide living cooking services in their restaurants, banquet halls, and outdoor venues. Living cooking generally requires a buffet station which is convenient to move around and equipped with a cooking module. The cooking module can be an induction cooker, an oven, a steaming stove or other cooking appliances. Buffet stations are relatively large in size. Generally, a chef will cook on site in a buffet service, and the diners choose the ingredients according to their own wishes.

However, due to the large size of buffet stations, there are disadvantages such as difficult transportation and large storage space during the process of transportation or storage. Therefore, it is necessary to provide a foldable buffet station to solve the technical problems of existing buffet stations.

BRIEF SUMMARY OF THE INVENTION

In view of the aforesaid disadvantages now present in the prior art, the present invention provides a foldable buffet station. During transportation, the buffet station itself can be folded to greatly reduce its own volume and facilitate transportation. During storage, the space occupied can be greatly reduced by folding. As a result, shortcomings of existing buffet stations such as difficult transportation, large storage space and so forth are overcome.

The objects of the present invention are achieved as follows:

A foldable buffet station comprising supporting legs, wheels mounted at lower ends of the supporting legs, and a countertop frame fixedly connected to upper ends of the supporting legs; at least one detachable cooking module is mounted on the countertop frame; the supporting legs comprise two sets of supporting panels which are separated at an interval at a left-right direction; each set of the supporting panels comprises a front supporting panel and a rear supporting panel which are rotationally connected; each of the rear supporting panels is provided with a back side supporting panel at a rear end thereof along the left-right direction; the two back side supporting panels are separated from each other for a distance; the countertop frame comprises a front beam, a rear beam and two left and right side beams which form a rectangular frame; the two left and right side beams are respectively fixed at upper ends of the two rear supporting panels on left and right sides; the rear beam is detachably fixed at upper ends of the two back side supporting panels; the front beam is fixed at upper ends of the two front side supporting panels; the front supporting panels, the rear supporting panels, and the two back side supporting panels have same heights; the front beam, the rear beam and the two left and right side beams have same heights.

Specifically, a front end of each of the front supporting panels is connected with a front side supporting panel in the left-right direction; the two front side supporting panels are separated from each other for a distance; a receiving space is formed between the front supporting panel, the rear supporting panel, the front side supporting panel and the back side supporting panel on same side; a cabinet and an electric box rotationally connected thereto are mounted in each of the receiving spaces along a front-rear direction; the cabinet is fixedly mounted on the corresponding front supporting panel; the electric box is fixedly mounted on the corresponding rear supporting panel, so that the front supporting panel and the corresponding rear supporting panel are rotationally connected; adjacent sides of the electric box and the cabinet in each of the receiving spaces are pivotally connected by a concealed hinge; the electric box and the rear supporting panel on same side can be rotated inward by the concealed hinge.

Specifically, at least one first power supply socket is mounted on the rear beam; each of the first power sockets is respectively connected with a first power cord; a first end of the first power cord extends from an end of the rear beam into an interior of the rear beam and is connected to the first power socket, and a second end of the first power cord is connected with a first plug; a second power supply socket and a power interface are mounted on the electric box; the power interface is connected to an external power source via a second power cable; the first power supply socket is electrically connected to the second power supply socket via the first power cord.

Specifically, a rear beam bracket with a horizontal supporting surface is provided at an inner side of each of the rear supporting panels; the rear beam bracket and the corresponding rear supporting panel are pivotally connected along a vertical direction, so that the rear beam bracket can rotate vertically.

Specifically, the front beam comprises a main front beam and two side front beams respectively fixed to two ends of the main front beam; the two side front beams are connected by a supporting beam; an upper surface of the supporting beam flushes with a bottom side of a groove; the supporting beam divides an interior of the countertop frame into two parts, front and back respectively; the supporting beam and the main front beam are connected by a reinforcing beam.

Specifically, the two front side supporting panels are connected by an upper front apron; the upper front apron is located at a lower end of the front beam; a front apron is detachably connected to a lower end of the upper front apron; a front apron hanging slot is provided at an inner side of the upper front apron; a hook that cooperates with the front apron hanging slot is fixed on the front apron; the front apron is hung at the lower end of the upper front apron via the hook.

Specifically, each of the back side supporting panels and the front side supporting panels has same width along the left-right direction; the cabinet and the electric box each has a width along the left-right direction which does not exceed the width along the left-right direction of each of the back side supporting panels; the rear supporting panel has a width along the front-rear direction which is greater than that of the front supporting panel; wheels are respectively mounted on bottom sides of each of the cabinets and each of the electric boxes; the upper end of each of the back side supporting panels is provided with a fixing pin; a lower end of the rear beam is provided with fixing holes corresponding to the fixing pins; cooperation between the fixing pins and the fixing holes enables the rear beam to be detachably fixed to the upper ends of the two back side supporting panels.

Specifically, a buckle is provided on a side wall of each of the two back side supporting panels which faces each other; a buckle base is fixedly mounted corresponding to each of the buckles on a lower end of the supporting beam; after the two back side supporting panels are rotated inward, the corresponding buckles and buckle bases are snap connected.

Specifically, the countertop frame is a rectangular frame; a groove is peripherally arranged on an inner side of an upper end of the countertop frame; each of the cooking modules has a peripheral edge; the groove has a bottom side which forms a support against the edge of each of the cooking modules; each of the cooking modules has an upper surface which does not exceed an upper surface of the countertop frame after assembling.

The beneficial effects of the present invention are as follows:

The foldable buffet station of the present invention comprises supporting legs and a countertop frame mounted on upper ends of the supporting legs. The supporting legs comprise two sets of supporting panels on left and right sides. Each set of the supporting panels comprises a front supporting panel and a rear supporting panel which are rotationally connected. The countertop frame comprises a front beam, a rear beam, and two left and right side beams which form a rectangular frame. The two left and right side beams are respectively fixed at upper ends of the two rear supporting panels on left and right sides. The rear beam is detachably fixed at upper ends of the two back side supporting panels. The front beam is fixed at upper ends of the two front side supporting panels. When it is necessary to fold the buffet station, the cooking module on the countertop frame is removed first, and then the rear beam is removed; since the front supporting panels and the rear supporting panels are rotationally connected, pushing the two rear supporting panels at this time results in rotation and folding, and the side beams follow the corresponding supporting panels to rotate. As a result, the occupying space of the entire buffet station can be greatly reduced, which is convenient for transportation and storage.

In the figures, 1 denotes the cooking module, 11 denotes the module handle, 2 denotes the countertop frame, 20 denotes the groove, 21 denotes the front beam, 211 denotes the main front beam, 212 denotes the side front beam, 22 denotes the side beam, 23 denotes the rear beam, 24 denotes the supporting beam, 241 denotes the reinforcing beam, 25 denotes the upper front apron, 251 denotes the front apron hanging slot, 3 denotes the supporting leg, 31 denotes the front supporting panel, 311 denotes the front side supporting panel, 312 denotes the cabinet, 32 denotes the rear supporting panel, 321 denotes the back side supporting panel, 322 denotes the electric box, 3211 denotes the fixing pin, 33 denotes the rear beam bracket, 34 denotes the front apron, 341 denotes the hook, 35 denotes the concealed hinge, 37 denotes the buckle, 38 denotes the buckle base, 381 denotes the spring mounting tube, 382 denotes the blocking bead, 39 denotes the buckle mounting rod, 4 denotes the wheel, 51 denotes the first power supply socket, 52 denotes the first power cord, 53 denotes the first plug, 54 denotes the second power supply socket, 55 denotes the second power cord, 6 denotes the plate rack, 61 denotes the plate rack leg.

DETAILED DESCRIPTION OF THE INVENTION

The present invention will be further described in detail below with reference to the accompanying drawings and an embodiment.

Figure 11:
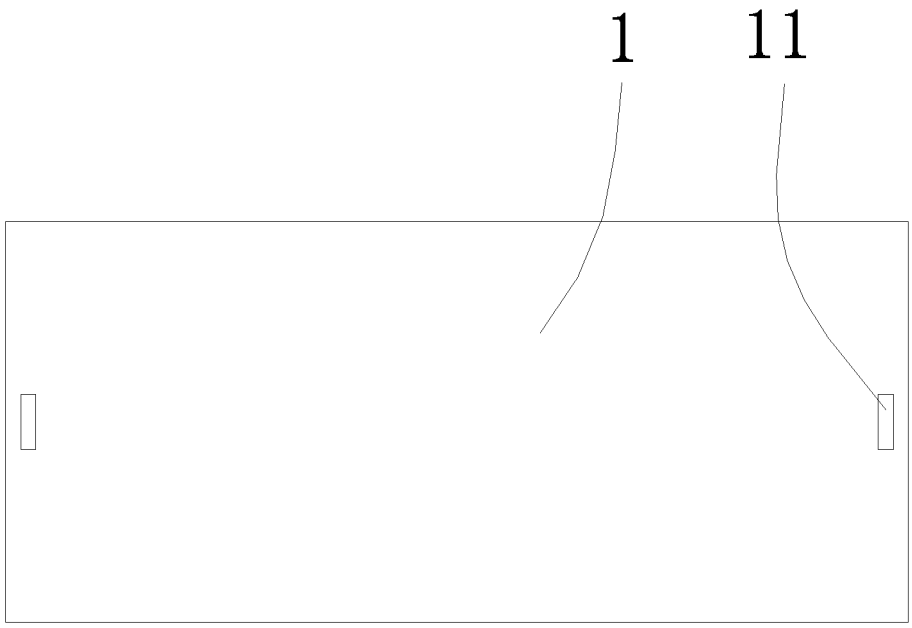
FIG. 11 illustrates an optional structure of the cooking module of the present invention.
Figure 12:
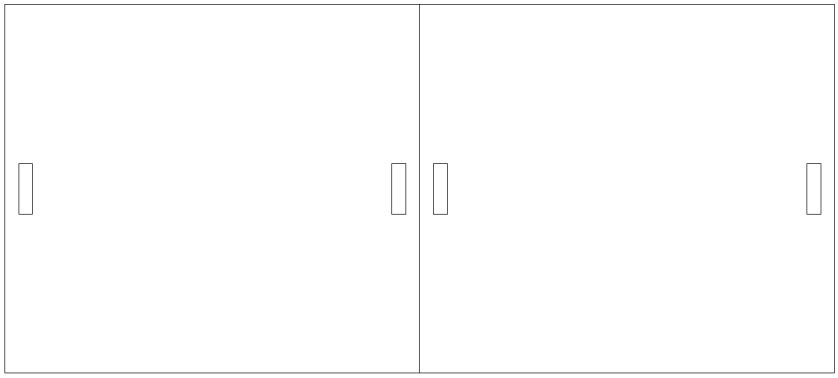
FIG. 12 is the first layout diagram of the cooking modules of the present invention.
Figure 13:
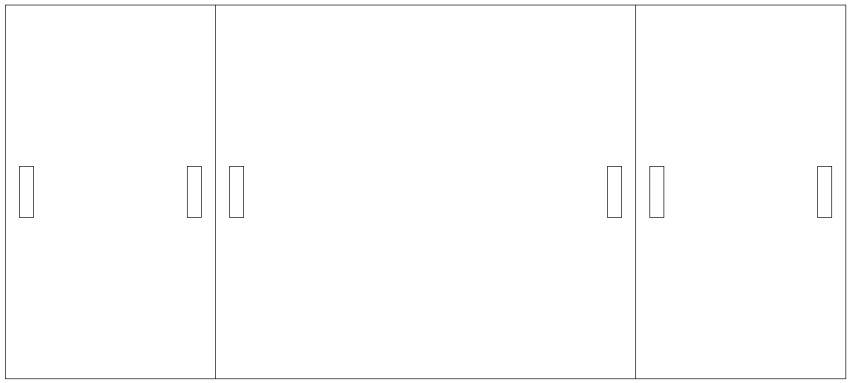
FIG. 13 is the second layout diagram of the cooking modules of the present invention.
Figure 14:
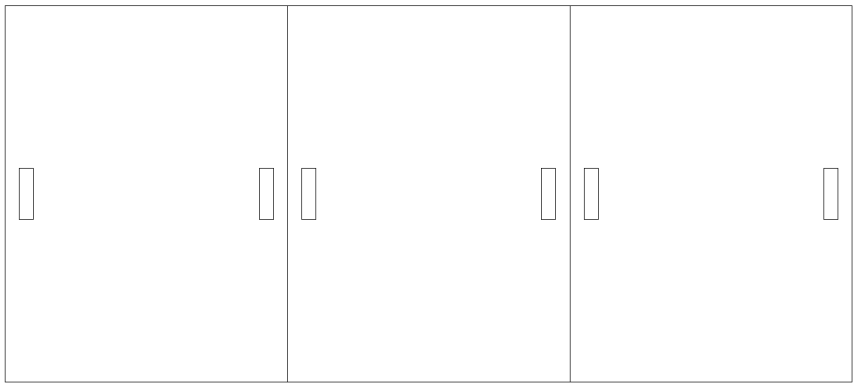
FIG. 14 is the third layout diagram of the cooking modules of the present invention.
Figure 15:
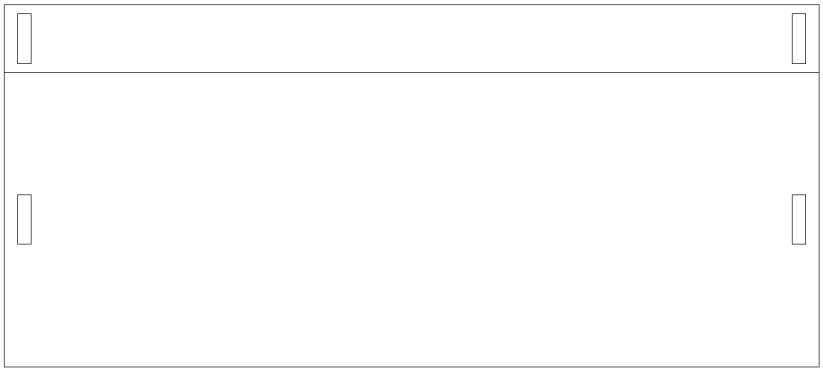
FIG. 15 is the fourth layout diagram of the cooking modules of the present invention.
Figure 16:
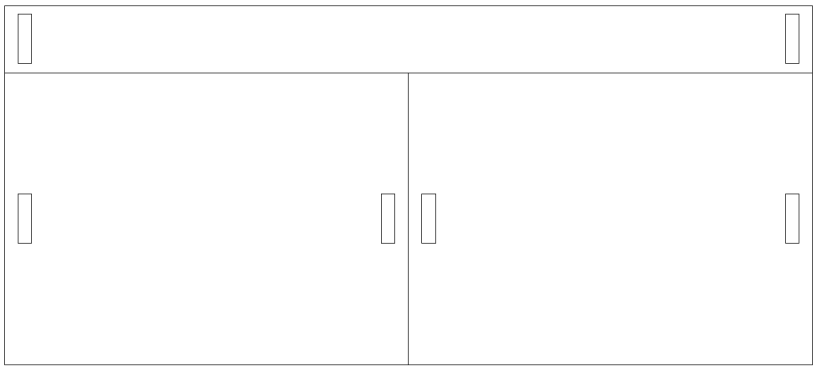
FIG. 16 is the fifth layout diagram of the cooking modules of the present invention.
Figure 17:
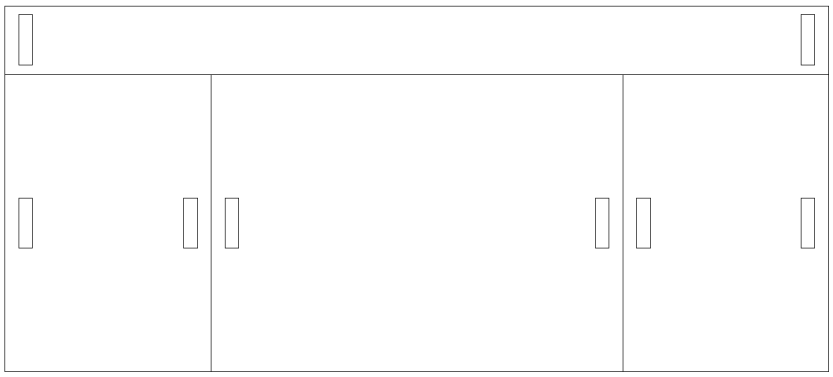
FIG. 17 is the sixth layout diagram of the cooking modules of the present invention.
Figure 18:
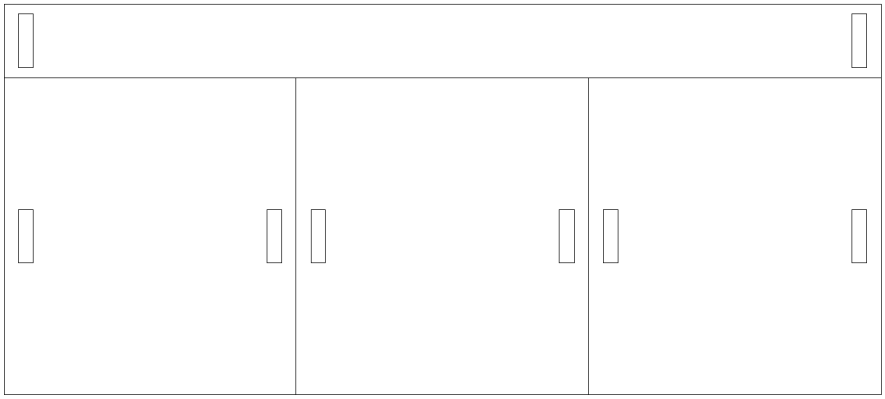
FIG. 18 is the seventh layout diagram of a cooking modules of the present invention.
Figure 19:
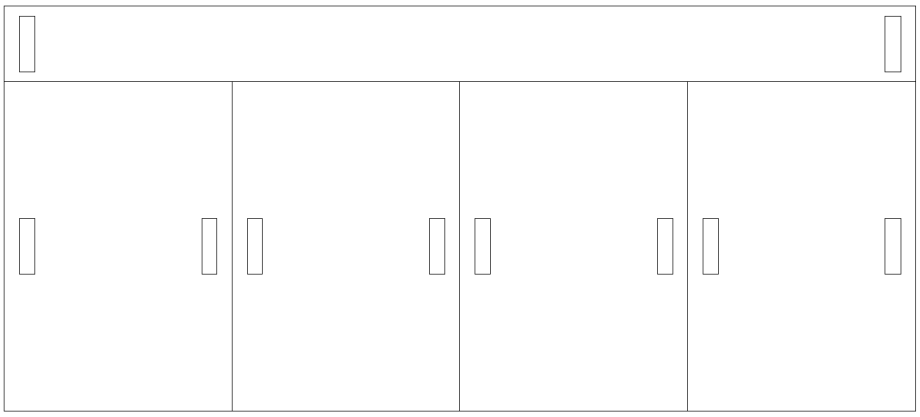
FIG. 19 is the eighth layout diagram of the cooking modules of the present invention.
Figure 20:
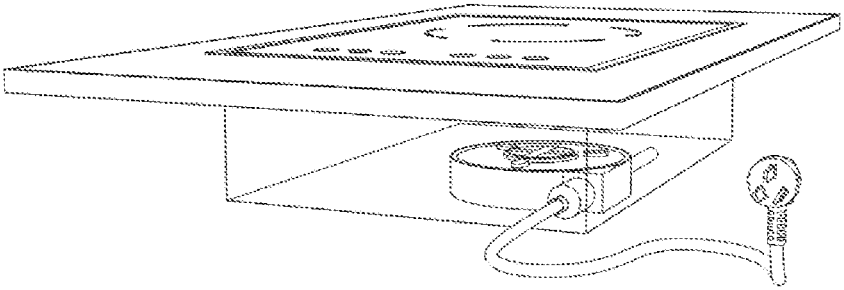
FIG. 20 is the ninth layout diagram of the cooking modules of the present invention.

As shown in FIGS. 1-11, the foldable buffet station comprises supporting legs 3, wheels 4 mounted at lower ends of the supporting legs 3, and a countertop frame 2 fixedly connected to upper ends of the supporting legs 3. The countertop frame 2 is a rectangular frame. A groove 20 is peripherally arranged on an inner side of an upper end of the countertop frame 2. At least one detachable cooking module 1 is mounted on the countertop frame 2. Each of the cooking modules 1 has a peripheral edge. The groove 20 has a bottom side which forms a support against the edge of each of the cooking module 1. Each of the cooking modules 1 has an upper surface which does not exceed an upper surface of the countertop frame 2 after assembling. As shown in FIG. 11, an optional cooking module of the present invention comprises a cooking portion at a central part and an edge surrounding the cooking portion. The edge is used to support the weight of the entire cooking module 1 during assembling.

In this embodiment, the type and specification of the cooking module 1 can be changed at any time according to actual needs. The arrangements of the cooking modules 1 on the countertop frame 2 are different according to the specifications of the cooking modules. In this embodiment, nine arrangements are provided as shown in FIGS. 12-20. It should be noted that the protection scope of the present invention is not limited to the arrangements listed in this embodiment; other reasonable arrangements should also fall within the scope of protection of the present invention. Preferably, a module handle 11 may be provided on the cooking module 1. The module handle 11 is preferably in form of a downward recess. The module handle 11 is provided to facilitate disassembling and assembling of the cooking module 1.

Figure 1:
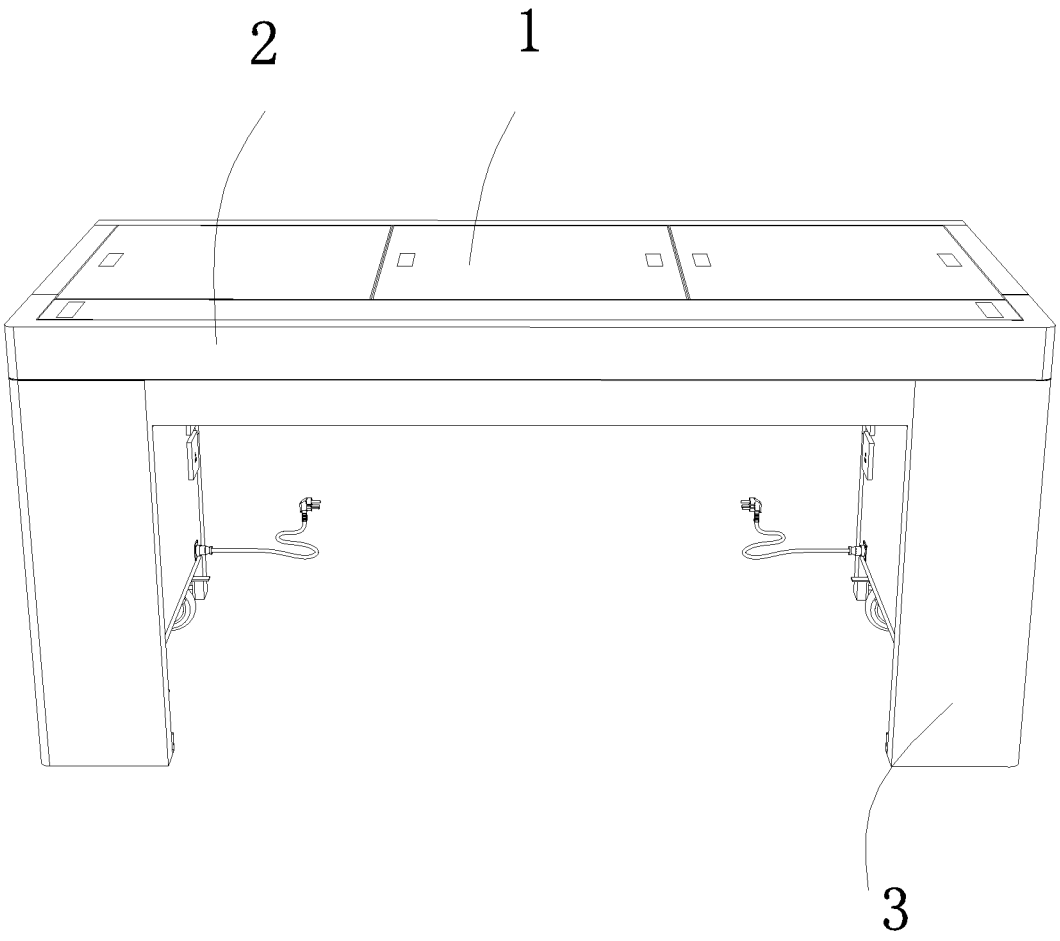
FIG. 1 is a schematic diagram of the overall structure of the present invention.
Figure 2:
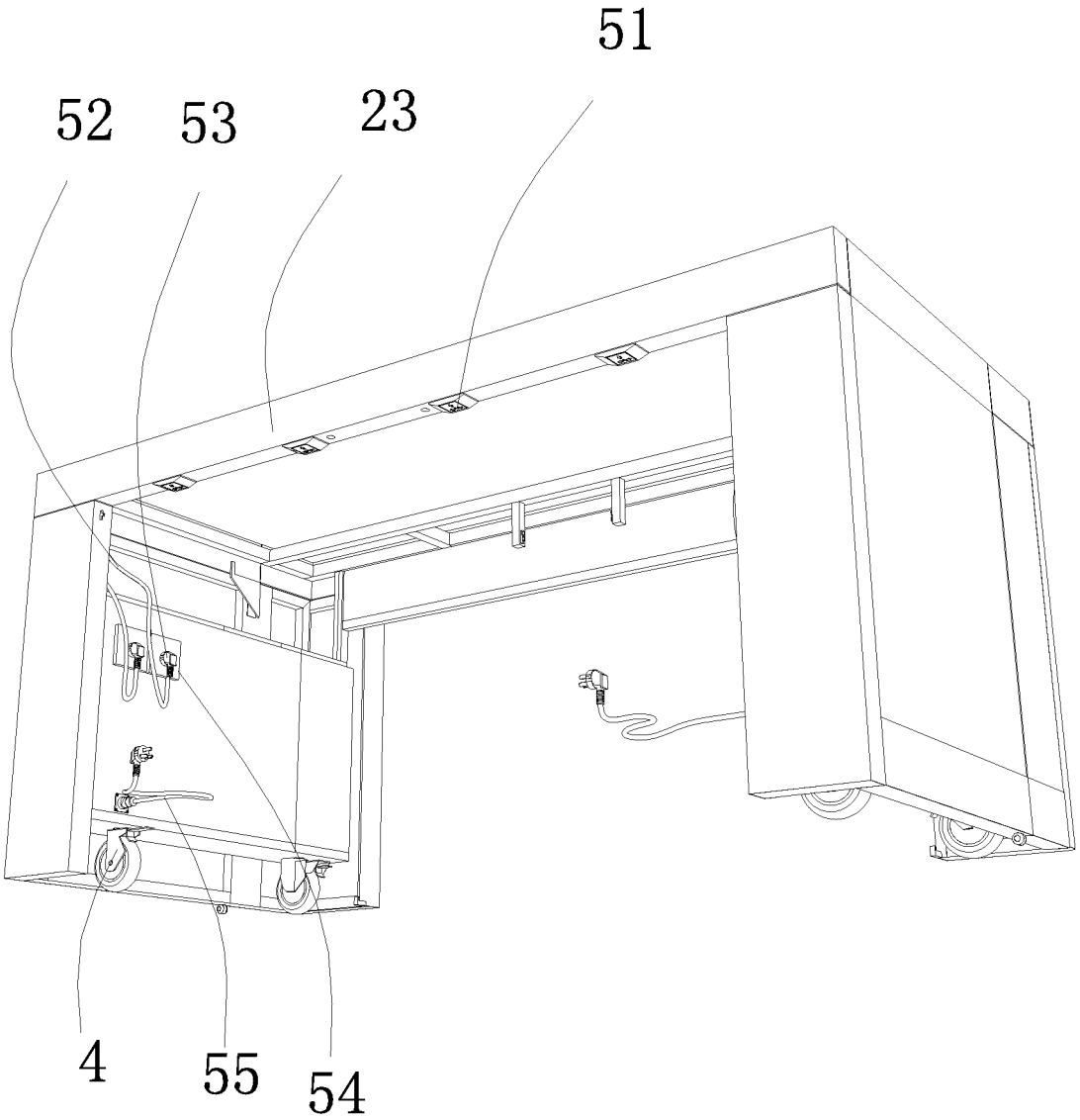
FIG. 2 is another schematic diagram of the overall structure of the present invention.
Figure 3:
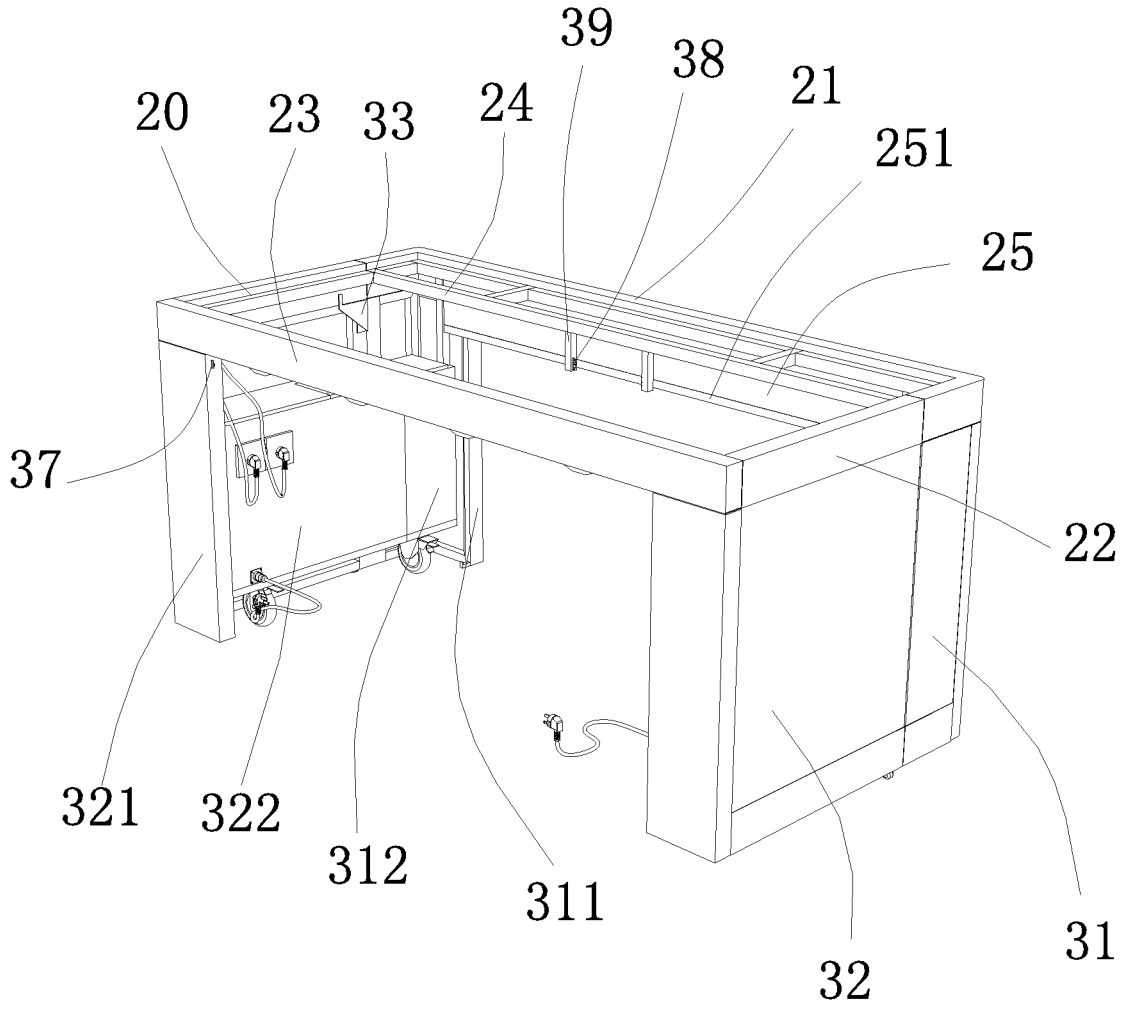
FIG. 3 is a schematic diagram of the present invention before the cooking modules are mounted.
Figure 4:
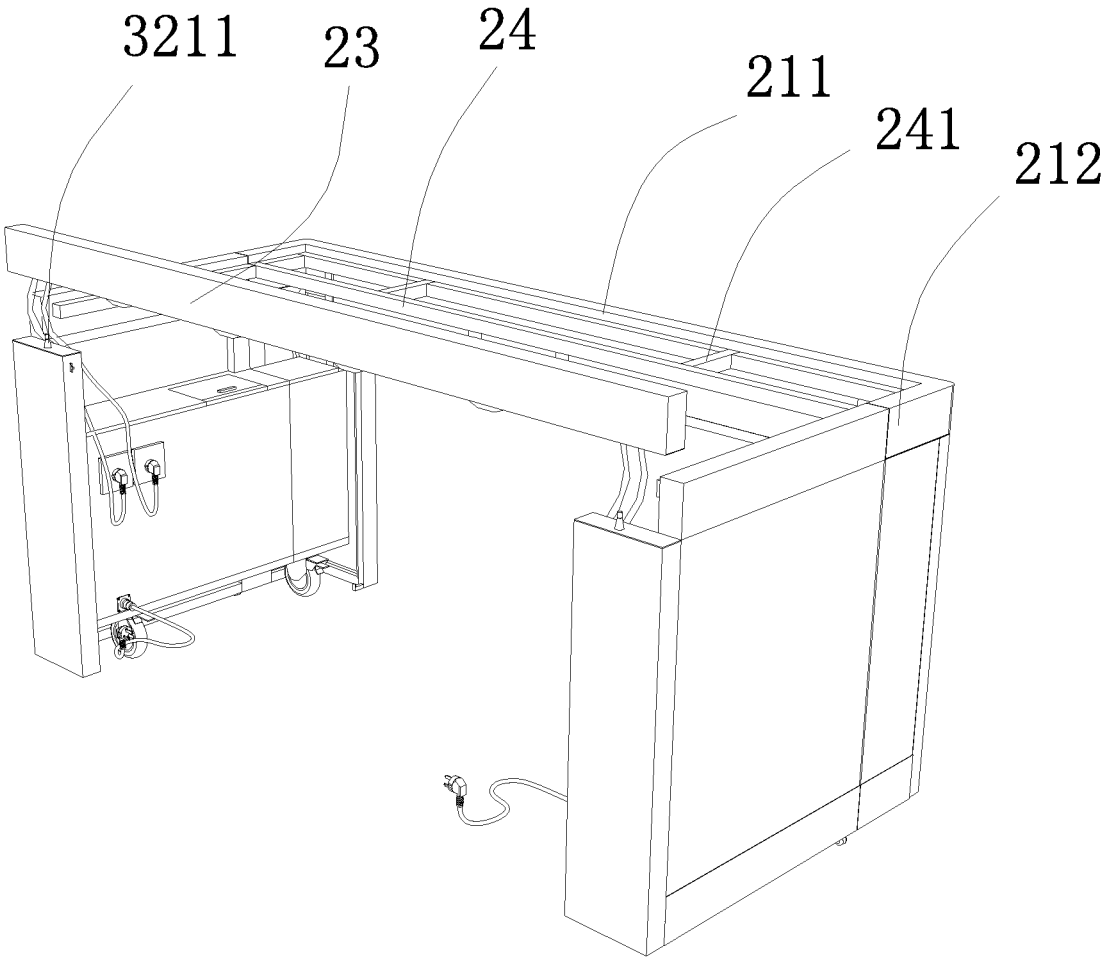
FIG. 4 is a schematic diagram of the present invention with the rear beam removed.
Figure 5:
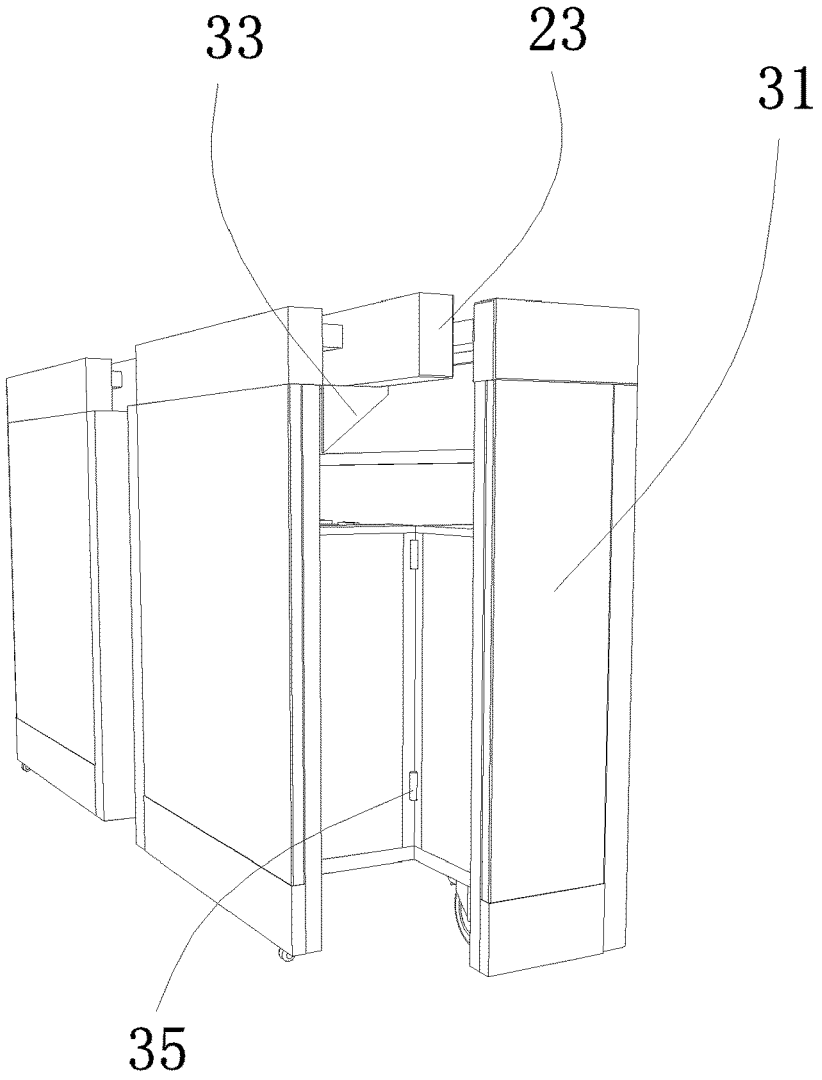
FIG. 5 is a schematic diagram of the present invention after being folded.
Figure 6:
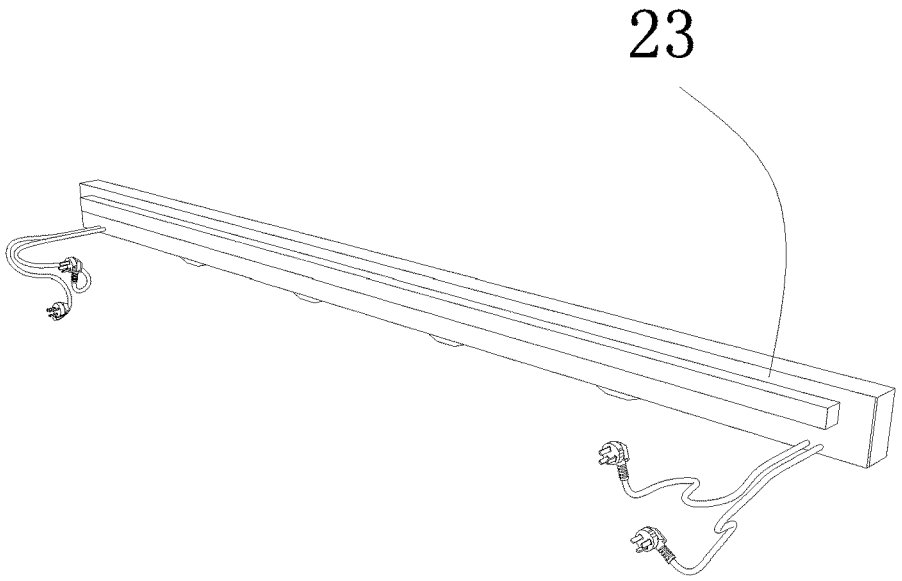
FIG. 6 is a schematic diagram of the rear beam of the present invention.
Figure 7:
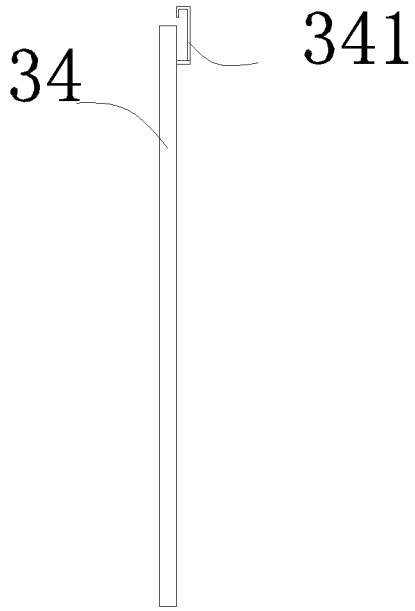
FIG. 7 is a schematic diagram of the front apron of the present invention.

Specifically, the supporting legs 3 comprise two sets of supporting panels which are separated at an interval at a left-right direction. Each set of the supporting panels comprises a front supporting panel 31 and a rear supporting panel 32 which are rotationally connected. Each of the rear supporting panels 32 is provided with a back side supporting panel 321 at a rear end thereof along the left-right direction. The two back side supporting panels 321 are separated from each other for a distance. The countertop frame comprises a front beam 21, a rear beam 23, and two left and right side beams 22 which form a rectangular frame. The two left and right side beams 22 are respectively fixed at upper ends of the two rear supporting panels 32 on left and right sides. The rear beam 23 is detachably fixed at upper ends of the two back side supporting panels 321. The front beam 21 is fixed at upper ends of the two front supporting panels 31. The front supporting panels 31, the rear supporting panels 32, the two back side supporting panels 321 have same heights. The front beam 21, the rear beam 23, and the two left and right side beams 22 have same heights. Due to large size of buffet stations, there are disadvantages such as difficult transportation and large storage space during the process of transportation or storage. In this embodiment, during transportation or when not in use, the cooking module 1 and the rear beam 23 are removed and the rear supporting panels 32 are rotated inwards and folded, thereby effectively reducing the occupying space and providing convenience for transportation. The folding effect is shown in FIG. 5.

Specifically, a front end of each of the front supporting panels 31 is connected with a front side supporting panel 311 in the left-right direction. The two front side supporting panels 311 are separated from each other for a distance. A receiving space is formed between the front supporting panel 31, the rear supporting panel 32, the front side supporting panel 311 and the back side supporting panel 321 on the left side. Another receiving space is formed between the front supporting panel 31, the rear supporting panel 32, the front side supporting panel 311 and the back side supporting panel 321 on the right side. A cabinet 312 and an electric box 312 rotationally connected thereto are mounted in each of the receiving spaces along a front-rear direction. The cabinet 312 is fixedly mounted on the corresponding front supporting panel 31, and the electric box 322 is fixedly mounted on the corresponding rear supporting panel 32, so that the front supporting panel 31 and the corresponding rear supporting panel 32 are rotationally connected; Adjacent sides of the electric box 322 and the cabinet 312 in each of the receiving spaces are pivotally connected by a concealed hinge 35. The electric box 322 and the rear supporting panel 32 on the same side can be rotated inward by the concealed hinge 35. With this arrangement, when folding is performed in this embodiment, the cooking module 1 and the rear beam 23 are first detached, and then the rear supporting panels 32 on the left and right sides are respectively folded inward, and the electric box 322 is rotated in relation to the cabinet 312 by the concealed hinge 35. Since the rear supporting panel 32 is fixedly connected to the electric box 322, the rear supporting panel 32 is rotated with the electric box 322, and achieving rotational connection with the front supporting panel 31 indirectly. The concealed hinge 35 renders the appearance of the present embodiment neat and aesthetically pleasing.

Specifically, at least one first power supply socket 51 is mounted on the rear beam 23. Each of the first power sockets 51 is respectively connected with a first power cord 52. A first end of the first power cord 52 extends from an end of the rear beam 23 into an interior of the rear beam 23 and is connected to the first power socket 51, and a second end of the first power cord 52 is connected with a first plug 53. A second power supply socket 54 and a power interface are mounted on the electric box 322. The power interface is connected to an external power source via a second power cable 55. The first power supply socket 51 is electrically connected to the second power supply socket 54 via the first power cord 52. By providing a first power supply socket 51 on the rear beam 23, the first power supply socket 51 can facilitate power supply to the cooking module 1. Concealing the first power cord 52 inside the rear beam 23 can prevent the first power cord 52 from being entangled and thereby reducing danger. By providing the electric box 322, only one power interface is required to be provided on the electric box 322, and only one second power cord 55 is required for connecting the external power source; providing a plurality of second power supply sockets 54 on the electric box 322 facilitates power supply to a plurality of first power supply sockets 51. Preferably, a power cord storage box may be provided on the electric box 322 for receiving the second power cord 55.

Specifically, a rear beam bracket 33 with a horizontal supporting surface is provided at an inner side of each of the rear supporting panels 32. The rear beam bracket 33 and the corresponding rear supporting panel 32 are pivotally connected along a vertical direction, so that the rear beam bracket 33 can rotate vertically. It should be understood that since the electric box 322 has a certain width, after the electric box 322 is rotated inward and folded around the concealed hinge, there will be a certain distance between the rear supporting panel 32 and the front supporting panel 3; at this time, the rear beam bracket 33 is rotated to be perpendicular to the plane of the rear supporting panel 32, and the detached rear beam 23 can be placed on the rear beam bracket 33; at this time, the rear beam 23 is located in a gap between the rear supporting panel 32 and the front supporting panel 31, thus facilitating transportation and storage. In the present embodiment, the optimal folding angle of the rear supporting panel 32 relative to the front supporting panel 31 is 90°.

Specifically, the front beam 21 comprises a main front beam 211 and two side front beams 212 respectively fixed to two ends of the main front beam 211. The two side front beams 212 are connected by a supporting beam 24. An upper surface of the supporting beam 24 flushes with the bottom side of the groove 20. The supporting beam 24 divides the interior of the countertop frame 2 into two parts, front and back respectively. The supporting beam 24 and the main front beam 21 are connected by a reinforcing beam 241. The supporting beam 24 can be used to provide a load-bearing function for the cooking module 1, which is convenient for more arrangements of the cooking module 1; for example, in the arrangements as shown in FIGS. 15-19, the edges of the cooking module 1 require the support of the supporting beam 24.

Specifically, the two front side supporting panels 311 are connected by an upper front apron 25. The upper front apron 25 is located at a lower end of the front beam 21. A front apron 34 is detachably connected to a lower end of the upper front apron 25. A front apron hanging slot 251 is provided at an inner side of the upper front apron 25. A hook 341 that cooperates with the front apron hanging slot 251 is fixed on the front apron 34. The front apron 34 is hung at the lower end of the upper front apron 25 via the hook 341. The front apron renders the overall structure of the station more aesthetically pleasing.

Specifically, each of the back side supporting panels 321 and the front side supporting panels 311 has same width along the left-right direction. The cabinet 312 and the electric box 322 each has a width along the left-right direction which does not exceed the widths along the front-rear direction of each of the back side supporting panels 321. The rear supporting panel 32 has a width along the front-rear direction which is greater than that of the front supporting panel 31. Wheels 4 are respectively mounted on bottom sides of each of the cabinets 312 and each of the electric boxes 322. The upper end of each of the back side supporting panels 321 is provided with a fixing pin 3211, and a lower end of the rear beam 23 is provided with fixing holes corresponding to the fixing pins 3211. The cooperation between the fixing pins 3211 and the fixing holes enables the rear beam 23 to be detachably fixed to the upper ends of the two back side supporting panels 321. Preferably, the wheels 4 are swivel casters, and the wheels 4 are provided with braking devices.

Figure 8:
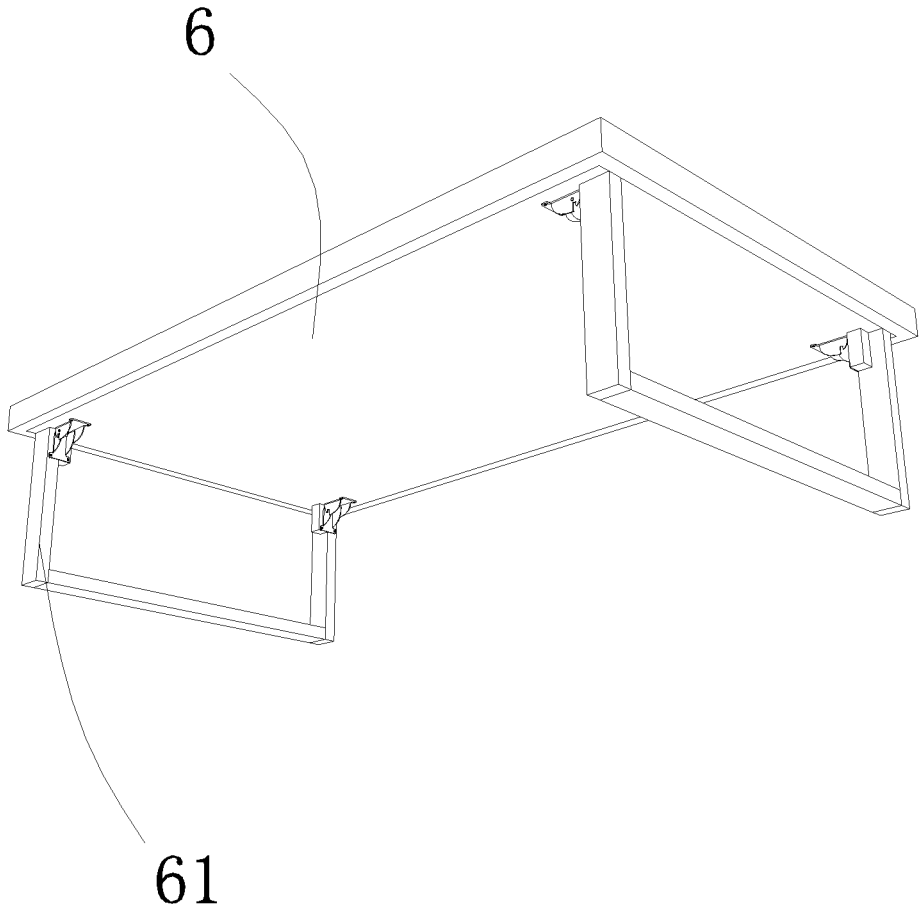
FIG. 8 is a schematic diagram of the plate rack of the present invention.
Figure 9:
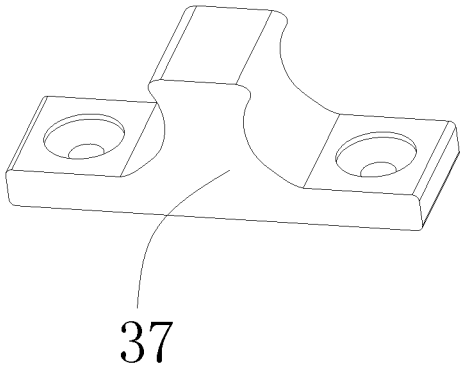
FIG. 9 is a schematic diagram of the buckle of the present invention.
Figure 10:
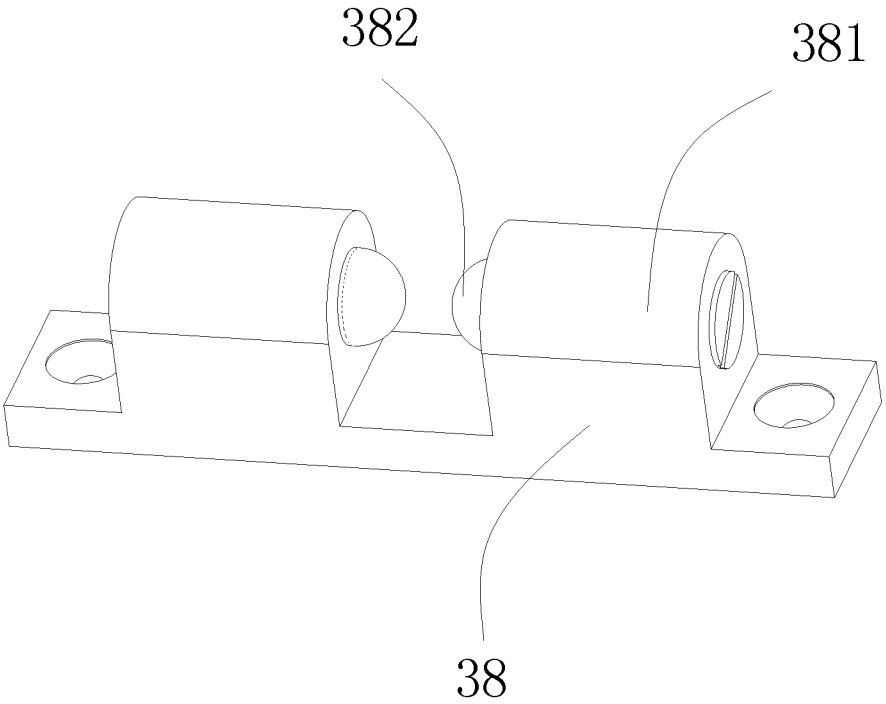
FIG. 10 is a schematic diagram of the buckle base of the present invention.

Specifically, a buckle 37 is provided on a side wall of each of the two back side supporting panels 321 which faces each other. Two buckle mounting rods 39 are fixedly connected on a lower end of the supporting beam 24. Each of the buckle mounting rods 39 is respectively mounted with a buckle base 38 which is snap connected with the buckle 37. As an optional implementation of the present embodiment, as shown in FIGS. 8-9, a flange is provided on the buckle 37; a neck is provided in a middle portion of the flange on the buckle 37; two spring mounting tubes 381 are provided on the buckle base 38; the spring mounting tubes 381 are each provided with a spring inside; an end of each of the two springs which faces each other is connected to a ball-shaped blocking bead 382; the two blocking beads 382 move toward each other under the push of the springs. After the rear supporting panels 32 are rotated and folded, the buckles 37 fixed on the back side supporting panels 321 can be snap connected with the buckle bases 37 fixed on the buckle mounting rods 39, thereby preventing the rear supporting panels 32 and the electric box 322 from swinging due to the lack of fixing during the pushing process after folding; when needed, pulling the rear supporting panels 32 results in contraction of the springs and detachment of the buckles 37 from the buckle bases 38.

Specifically, in the present embodiment, plate racks 6 may be provided inside the supporting legs 3. The plate racks 6 are provided below the countertop frame 2. Foldable plate rack legs 61 are provided under the countertop frame 2. The plate racks 6 can be used for receiving plates or other items.

The above embodiments are merely illustrative of the preferred embodiments of the present invention, and are not intended to limit the scope of the present invention. Simple and equivalent variations and modifications made to the disclosure of the present invention shall fall within the protection scope determined by the claims of the present invention.

What is claimed is:

1. A foldable buffet station comprising supporting legs, wheels mounted at lower ends of the supporting legs, and a countertop frame fixedly connected to upper ends of the supporting legs; at least one detachable cooking module is mounted on the countertop frame; characterized in that the supporting legs comprise two sets of supporting panels which are separated at an interval at a left-right direction; each set of the supporting panels comprises a front supporting panel and a rear supporting panel which are rotationally connected; each of the rear supporting panels is provided with a back side supporting panel at a rear end thereof along the left-right direction; the two back side supporting panels are separated from each other for a distance; the countertop frame comprises a front beam, a rear beam and two left and right side beams which form a rectangular frame; the two left and right side beams are respectively fixed at upper ends of the two rear supporting panels on left and right sides; the rear beam is detachably fixed at upper ends of the two back side supporting panels; the front beam is fixed at upper ends of the two front side supporting panels; the front supporting panels, the rear supporting panels, and the two back side supporting panels have same heights; the front beam, the rear beam and the two left and right side beams have same heights; the front beam comprises a main front beam and two side front beams respectively fixed to two ends of the main front beam; the two side front beams are connected by a supporting beam; the supporting beam divides an interior of the countertop frame into two parts, front and back respectively; the supporting beam and the main front beam are connected by a reinforcing beam.

2. The foldable buffet station as in claim 1, characterized in that a front end of each of the front supporting panels is connected with a front side supporting panel in the left-right direction; the two front side supporting panels are separated from each other for a distance; a receiving space is formed between the front supporting panel, the rear supporting panel, the front side supporting panel and the back side supporting panel on same side; a cabinet and an electric box rotationally connected thereto are mounted in each of the receiving spaces along a front-rear direction; the cabinet is fixedly mounted on the corresponding front supporting panel; the electric box is fixedly mounted on the corresponding rear supporting panel, so that the front supporting panel and the corresponding rear supporting panel are rotationally connected; adjacent sides of the electric box and the cabinet in each of the receiving spaces are pivotally connected by a concealed hinge; the electric box and the rear supporting panel on same side can be rotated inward by the concealed hinge.

3. The foldable buffet station as in claim 2, characterized in that at least one first power supply socket is mounted on the rear beam; each of the first power sockets is respectively connected with a first power cord; a first end of the first power cord extends from an end of the rear beam into an interior of the rear beam and is connected to the first power socket, and a second end of the first power cord is connected with a first plug; a second power supply socket and a power interface are mounted on the electric box; the power interface is connected to an external power source via a second power cable; the first power supply socket is electrically connected to the second power supply socket via the first power cord.

4. The foldable buffet station as in claim 2, characterized in that a rear beam bracket with a horizontal supporting surface is provided at an inner side of each of the rear supporting panels; the rear beam bracket and the corresponding rear supporting panel are pivotally connected along a vertical direction, so that the rear beam bracket can rotate vertically.

5. The foldable buffet station as in claim 2, characterized in that the two front side supporting panels are connected by an upper front apron; the upper front apron is located at a lower end of the front beam; a front apron is detachably connected to a lower end of the upper front apron; a front apron hanging slot is provided at an inner side of the upper front apron; a hook that cooperates with the front apron hanging slot is fixed on the front apron; the front apron is hung at the lower end of the upper front apron via the hook.

6. The foldable buffet station as in claim 2, characterized in that each of the back side supporting panels and the front side supporting panels has same width along the left-right direction; the cabinet and the electric box each has a width along the left-right direction which does not exceed the width along the left-right direction of each of the back side supporting panels; the rear supporting panel has a width along the front-rear direction which is greater than that of the front supporting panel; wheels are respectively mounted on bottom sides of each of the cabinets and each of the electric boxes; the upper end of each of the back side supporting panels is provided with a fixing pin; a lower end of the rear beam is provided with fixing holes corresponding to the fixing pins; cooperation between the fixing pins and the fixing holes enables the rear beam to be detachably fixed to the upper ends of the two back side supporting panels.

7. The foldable buffet station as in claim 1, characterized in that a buckle is provided on a side wall of each of the two back side supporting panels which faces each other; a buckle base is fixedly mounted corresponding to each of the buckles on a lower end of the supporting beam; after the two back side supporting panels are rotated inward, the corresponding buckles and buckle bases are snap connected.

8. The foldable buffet station as in claim 1, characterized in that a groove is peripherally arranged on an inner side of an upper end of the countertop frame; each of the cooking modules has a peripheral edge; the groove has a bottom side which forms a support against the edge of each of the cooking modules; each of the cooking modules has an upper surface which does not exceed an upper surface of the countertop frame after assembling.

* * * * *